United States Patent [19]

Blank et al.

[11] Patent Number: 4,708,677

[45] Date of Patent: Nov. 24, 1987

[54] METHOD OF MEASURING THE TEMPERATURE OF A PHOTOCATHODE

[75] Inventors: Richard E. Blank, Roanoke; Albert F. Tien, Salem; Avraham Amith, Roanoke, all of Va.

[73] Assignee: ITT Electro Optical Products, a division of ITT Corporation, Roanoke, Va.

[21] Appl. No.: 814,148

[22] Filed: Dec. 27, 1985

[51] Int. Cl.[4] ..... H01J 9/233

[52] U.S. Cl. ..... 445/3; 374/123; 364/557; 445/51

[58] Field of Search ..... 374/123; 364/557; 445/3, 51

[56] References Cited

U.S. PATENT DOCUMENTS

| | | | |
|---|---|---|---|
| 3,245,261 | 4/1966 | Buteux | 374/123 |
| 3,759,102 | 9/1973 | Murray | 374/123 |
| 3,793,630 | 2/1974 | Meijer | 364/557 X |
| 4,418,392 | 11/1983 | Hata | 364/557 X |

FOREIGN PATENT DOCUMENTS

| | | | |
|---|---|---|---|
| 93269 | 8/1978 | Japan | 364/557 |

*Primary Examiner*—Kenneth J. Ramsey

*Attorney, Agent, or Firm*—Robert A. Walsh; Mary C. Werner

[57] ABSTRACT

A method of determing the actual temperature of a layer of an infrared material, especially during heat cleaning, which includes measuring the thickness of the layer and the amount of radiation being emitted from it. An apparent temperature corresponding to a desired actual temperature is found from a curve of apparent temperature, which are derived from the radiation amount, versus thickness. The apparent temperature which corresponds to the desired actual temperature compensates for interference effects on the radiation measurement. A computer may be utilized to calculated the apparent temperature which corresponds to the desired actual temperature and to regulate and maintain the infrared material at the apparent temperature.

5 Claims, 5 Drawing Figures

A TYPICAL FRINGE PATTERN FOR FIXED THICKNESS AS MEASURED BY FTIR

METHOD OF MEASURING THE TEMPERATURE OF A PHOTOCATHODE

BACKGROUND OF THE INVENTION

This invention relates to image intensifier tubes and more particularly to photoemissive cathodes for use in such tubes.

Image intensifier tubes multiply the amount of incident light they receive and thus provide an increase in light output which can be supplied either to a camera or directly to the eyes of a viewer. These devices are particularly useful for providing images from dark regions and have both industrial and military application. For example, these devices are used for enhancing the night vision of aviators, for photographing extraterrestrial bodies and for providing night vision to sufferers of retinitis pigmentosa (night blindness).

Image intensifier tubes utilize a photoemissive wafer which is bonded to a glass faceplate to form a cathode. Light enters the faceplate and strikes the wafer, thereby causing a primary emission of electrons.

After the formation of the cathode, a heat cleaning step is performed to remove contaminants, such as oxygen and carbon from the surface of the photoemissive wafer. Bringing the cathode to a specific temperature and maintaining the cathode at that temperature are necessary in effecting proper heat cleaning of the cathode so that its structure and properties are not adversely affected. Knowing the heat cleaning temperature is also necessary in order to avoid the formation of brush lines in the otherwise transparent photoemissive wafer.

Thermocouples cannot be used to measure the temperature of cathodes because they tend to damage the fragile surface of the cathode or give inaccurate readings. The most convenient method is radiative measurement of the temperature using a thermometer based on detection of blackbody radiation.

Instruments which detect infrared radiation a wavelengths for which the layers are transparent and the glass is opaque sense the radiation from a thin layer at the interface of the glass and wafer plus a contribution from the wafer. Due to the proximity of the interface to the gallium arsenide layer and the good thermal conductivity of semiconductors, the measured temperature is a good indicator of the true wafer temperature. However, the wafer acts as a thin film which causes the apparent temperature to vary by a large amount due to interference effects caused by multiple reflection of the blackbody radiation between the internal surfaces of the wafer. However, by measuring the thickness of the wafer and knowing the indices of refraction, a correction can be made for the interference.

One solution to the problem of accurate photocathode temperature measurement during heat cleaning is given in application Ser. No. 814,132, filed Dec. 27, 1985, entitled "Method of Measuring the Temperature of a Photocathode", in the name of A. Amith.

OBJECTS OF THE INVENTION

It is an object of the present invention to provide a method of measuring the temperature of a photoemissive wafer of a cathode.

It is an additional object of the present invention to provide an accurate temperature measurement of a photoemissive wafer during heat cleaning which is compensated for cathode interference.

SUMMARY OF THE INVENTION

These objects and others which will become apparent hereinafter are accomplished by the present invention which provides a method of determining the temperature of a layered structure which includes at least one layer of an infrared transparent material including measuring the thickness of the material, determining the level of radiation being emitted or transmitted through by the layered structure, applying a correction factor derived from the thickness measurement and calculating the temperature of the structure from the correction factor and the radiation level.

BRIEF DESCRIPTION OF THE DRAWING

The above-mentioned and other features and objects of this invention will become more apparent by reference to the following description taken in conjunction with the accompanying drawings in which.

DETAILED DESCRIPTION OF THE PREFERRED EMBODIMENT

Figure 1:
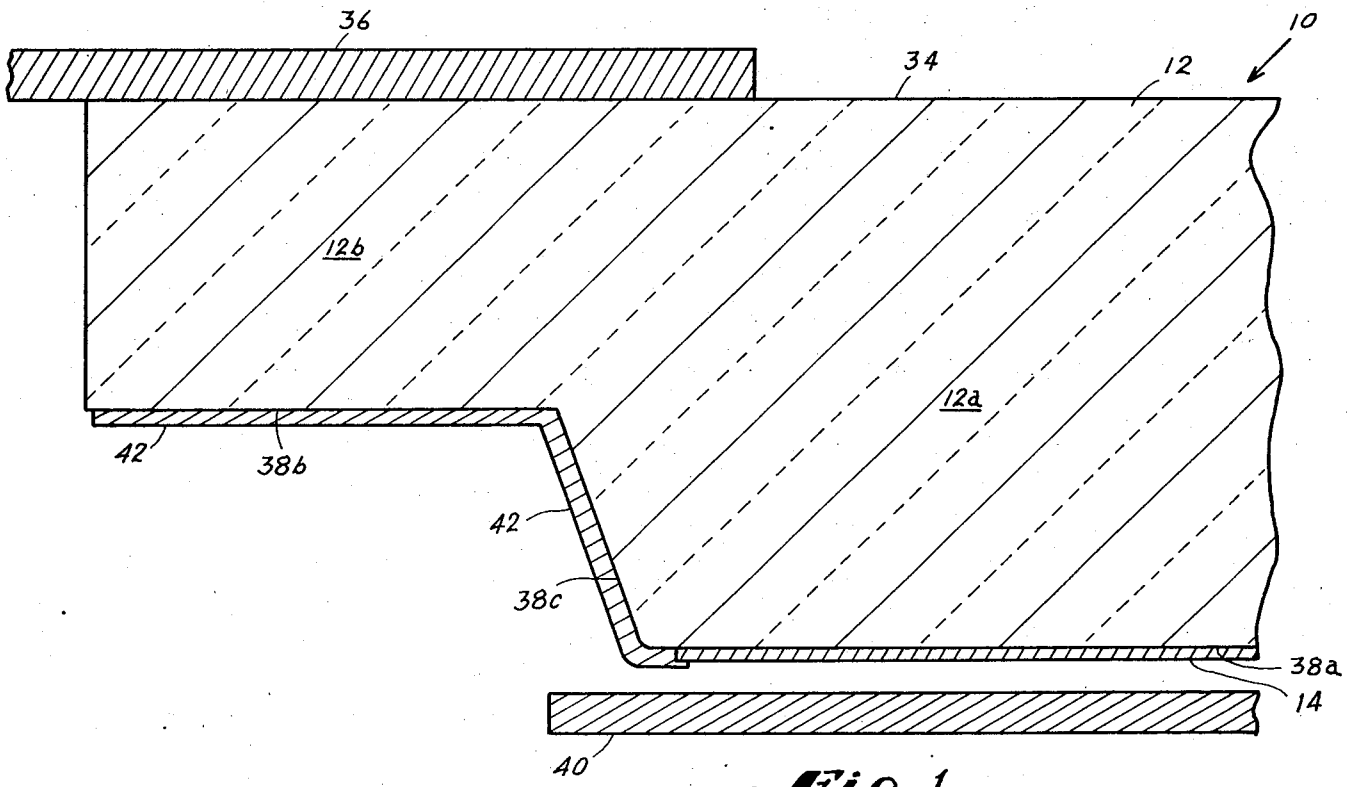
FIG. 1 is a cross-sectional view of a cathode usable in an image intensifier tube in accordance with this invention.

In FIG. 1 there is shown a cathode 10 which includes a faceplate 12 and a photoemissive wafer 14. The faceplate 12 can be made of a clear, high quality optical glass such as Corning 7056. This glass comprises 70 percent silica ($SiO_2$), 17 percent boric oxide ($B_2O_3$), 8 percent potash ($K_2O$), 3 percent alumina ($Al_2O_3$) and 1 percent each of soda ($Na_2O$) and lithium oxide ($Li_2O$). Other glasses may, of course, be used. In shape, the faceplate 12 includes a central, generally circular body portion 12*a* and a reduced thickness sill portion 12*b* in the form of a flange surrounding the body portion. One surface 34 of the faceplate 12 extends continuously across the body and sill portions 12*a* and 12*b*, respectively, and the portion of this surface extending over the sill portion 12*b* and a small adjacent portion of the central body portion 12*a* fits under a flange 36 and is secured thereto to retain the faceplate 12 in a housing (not shown). The remainder of the portion of surface 34, that is, that portion surrounded by the flange 36 is the exposed surface of the faceplate 12 on which input light impinges.

The faceplate 12 also includes surface portions 38*a* and 38*b* which are generally parallel to surface 34 and which extend over the body portion 12*a* and sill portion 12*b*, respectively. Because of the difference in thickness between the body portion 12*a* and the sill portion 12*b*, the surface portions 38*a* and 38*b* lie in different planes with the portion 38*a* being spaced farther from the surface 34 than is the portion 38*b*. Extending between the surface portions 38*a* and 38*b* is a connecting surface portion 38*c* which, in the embodiment disclosed herein, is generally frusto-conical.

The photoemissive wafer 14 is bonded to the surface portion 38*a* so that light impinging on the exposed portion of surface 34 and eventually striking the wafer 14 causes the emission of electrons. These electrons are accelerated across a gap by an electric field to a MCP 40 causing the secondary emission of electrons all in accordance with known principles. Connecting the photoemissive wafer 14 to an external biasing power supply (not shown) is a coating of conductive material 42 applied to the surfaces 16*b* and 16*c* and also over a portion of surface 16*a* so that this coating makes contact with the wafer 14.

Figure 2:
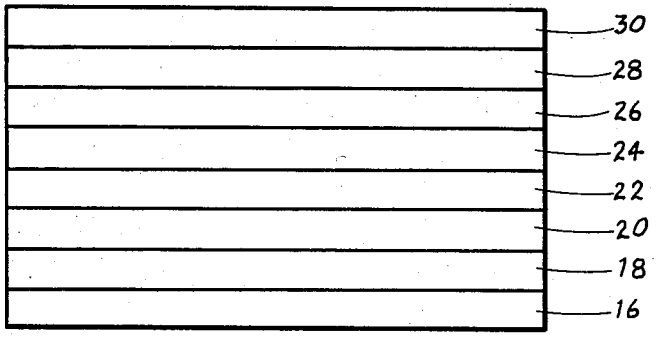
FIG. 2 is a cross-sectional view of the photoemissive wafer prior to bonding.

The photoemissive wafer 14 may be formed in any known manner. One such method is described with reference to FIG. 2. A gallium arsenide (GaAs) substrate 16 has formed on one of its surfaces a layer 18 of gallium arsenide (GaAs) which is identified as a buffer layer. The formation of the buffer layer 18 is to facilitate control of a later etching process to remove the substrate. An etch stop layer 20 of gallium aluminum arsenide (GaAlAs) is formed on top of the buffer layer 18 and an active layer 22 of gallium arsenide (GaAs) is formed on the etch stop layer 20.

The active layer 22 has a layer of gallium aluminum arsenide (GaAlAs) formed on its surface and is identified as the window layer 24. Generally, formation of the wafer 14 results in a structure which is larger than that required for the image intensifier tube. One way of achieving the proper diameter for the wafer 14 is to cut the wafer with a saw. If this step is to be performed, then cap layer 26 of gallium arsenide (GaAs) is formed on top of the window layer 24. This cap layer 26 will provide protection to the underlying structure during cutting to prevent chipping of the window layer 24.

Another way of achieving the proper wafer diameter is to carefully chip away the excess portions of the wafer 14 after it is bonded to the glass faceplate 12. In using this method, a cap layer is not necessary.

Preferably, the formation of each of the layers is by means of epitaxial growth.

If the cap layer 26 is used, it is removed after cutting, preferably by chemical means such as etching.

On the surface of the window layer 24 is deposited a thin layer 28 of silicon nitride ($Si_3N_4$). The silicon nitride layer 28 has a layer 30 of silicon dioxide ($SiO_2$) deposited on its surface. Both the silicon nitride layer 28 and the silicon dioxide layer 30 are preferably formed by sputter deposition. The structure so formed is identified as a wafer 32.

The wafer 32 is positioned with the silicon dioxide layer 30 against the surface portion 38*a* of the faceplate 12. The wafer 32 is bonded to the faceplate 12 in a bonding apparatus to form a unitary structure. The temperature in the bonding apparatus is raised and pressure is applied to the wafer 32 and the faceplate 12 for a length of time sufficient for bonding to occur and for a unitary structure to be formed. After bonding, the unitary structure is cooled.

Following cooling, the GaAs substrate 16 removed. This is preferably done by lapping off most of the substrate 16 by mechanical polishing. The remaining portion of the substrate 16 is thereafter removed by chemical etching. The buffer layer 18 and the etch stop layer 20 are also removed, preferably by a chemical etching process. The structure is now identified as the cathode 10.

The conductive coatings 42 are applied to the surface portions 38*b* and 38*c* and a small portion of 38*a* which is contiguous with 38*c*.

The cathode 10 is then heat cleaned to remove contaminants from the surface of the wafer 14. The heat cleaning temperature is dependent upon the nature of the contaminants and upon the nature of the surface from which the contaminants are to be removed; that is, the actual percentage of gallium and arsenic at the surface. Once the nature of the contaminants and the actual ratio of gallium to arsenic is known, a specific heat cleaning temperature is determined. A temperature of approximately 600° C. is sufficient to free contaminants such as oxygen and carbon where the ratio of gallium to arsenic is 1:1.

Figure 3:
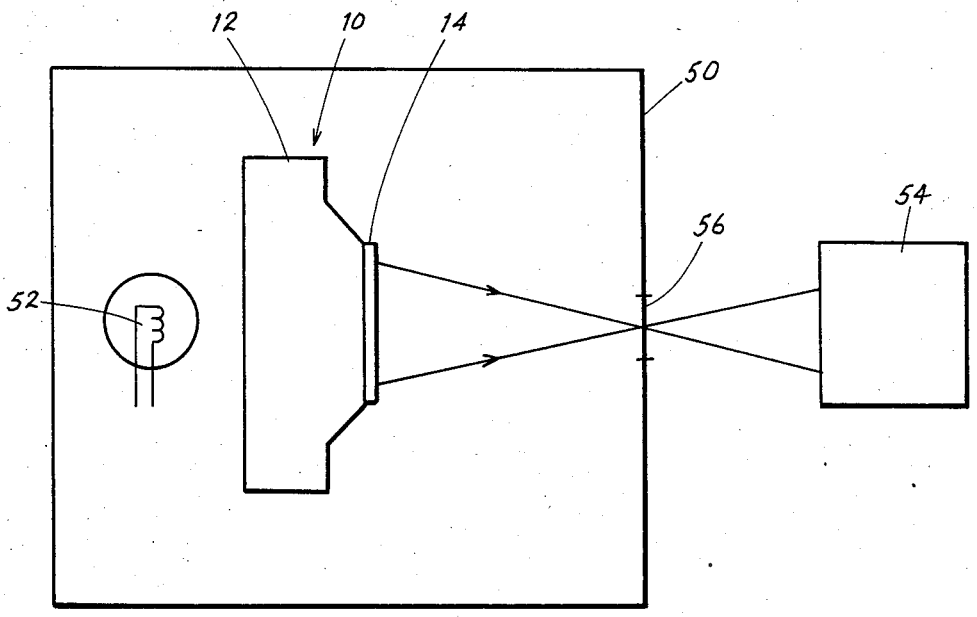
FIG. 3 is a diagrammatic representation of the temperature measuring apparatus of this invention.

Reference will now be made to FIG. 3. In order to perform the heat cleaning step, the cathode 10 is placed in a high vacuum chamber 50 and is heated to the predetermined temperature. A pyrometer 54 receives radiation emitted by the cathode 12 through a window 56 in the chamber 50. At the predetermined temperature contaminants are freed from the cathode 10 and are removed by the vacuum system. Heat is provided by means of a lamp 52, although any other suitable heat source may be used. The embodiment of the invention uses a predetermined temperature of approximately 600° C.

It is important to maintain the wafer 14 at the predetermined temperature in order to achieve proper surface cleaning and to avoid shading and instability in the wafer.

Another problem which is related to the heat cleaning temperature is the appearance of brush lines or crosshatching marks which result from stresses arising between the GaAs substrate 14 and the glass faceplate 12 during the cooling stage following bonding or heat cleaning. The lines or marks appear at a point within the range of temperatures used for heat cleaning. Therefore, it is important to maintain the heat cleaning temperature below that point.

Methods of measuring the temperature of the cathode include measurement of the peak wavelength being emitted by the cathode. Since the body emits an envelope of wavelengths, it is also possible to measure the intensity of any wavelength in the envelope. One instrument used to measure wavelengths in a specific range is a pyrometer which uses black body radiation to measure the peak wavelength being emitted by a body and translating that wavelength into temperature. The particular type of pyrometer used herein is an IRCON with an operating range of 4.8–5.2 $\mu$m.

However, the wafer 14 is very thin and it is difficult to monitor the blackbody radiation of such a thin layer, except if one chose to look only at a short wavelength whose absorption length is a small fraction of the cathode thickness (e.g. $\lambda < 0.6$ $\mu$m, where absorption length is less than 0.25 $\mu$m). This fundamental limitation is based on the relationship between the emittance and the absorbance. While using an IRCON type pyrometer instrument which is tuned to $\lambda = 0.6$ $\mu$m (or shorter) would enable one "in principle" to monitor the temperature of the cathode itself, this approach has numerous practical pitfalls, one of which is the extremely low intensity of 0.6 $\mu$m radiation at the temperatures of interest and another of which is the large amount of stray radiation present if a lamp is used for heating. The pyrometer is therefore really looking at the wavelengths being emitted by the faceplate and does not see the wavelengths being emitted by the wafer 14.

In addition, the transparency thickness and index of refraction of the wafer 14 cause light which enters one surface of the wafer 14 to be reflected one or more times before being transmitted through the other surface of the wafer. The result is a fringe pattern or fluctuation of energy and output with wavelengths which affect the pyrometer reading. A slight variation in thickness of the wafer 14 will affect the readings of the pyrometer since the interference phenomenon is very sensitive to thickness. Hence totally erroneous temperature readings will result from the spectral redistribution of energy caused by the interference.

It has been found that by measuring the thickness of the wafer 14, it is possible to determine the exact temperature using the pyrometer reading by applying a compensating factor for the thickness of the wafer 14, which factor takes into account the fringe pattern. Since the refractive indices of the gallium arsenide and gallium aluminum arsenide layers of the wafer 14 are almost identical, the wafer 14 may be considered to be a homogenous material. Therefore determining the thicknesses of the individual component layers of the wafer 14 is not necessary.

The apparent temperature of several cathodes is measured using an IRCON pyrometer under carefully controlled conditions such as by enclosing the cathodes in a heated cavity of accurately known and constant temperature. Cathodes are used which have the same wafer thickness. After the IRCON readings are taken and the apparent temperatures found, the cathodes are removed from the cavity and are cooled. Each of the cathodes then has a thin layer of the wafer 14 removed, for example, by etching. The thickness of the layer which is removed is made exactly the same for each cathode. The cathodes are again enclosed in a heated cavity and IRCON readings taken. The cathodes are again removed from the cavity and cooled. These steps are performed a number of times. At each IRCON reading stage, the apparent temperatures of the cathodes are averaged and used to establish an apparent temperature which corresponds to the desired actual temperature.

The thickness of each of the wafers 14 is measured either before or after heating by nondestructive means and confirmed by destructive means, if needed. One method of performing the destructive measurement includes cutting a cross section of the wafer 14 and viewing the cut section under an electron microscope. A curve of apparent temperatures, corresponding to a desired actual temperature, versus thickness is thus generated. This curve is also known as a correction curve.

Figure 4:
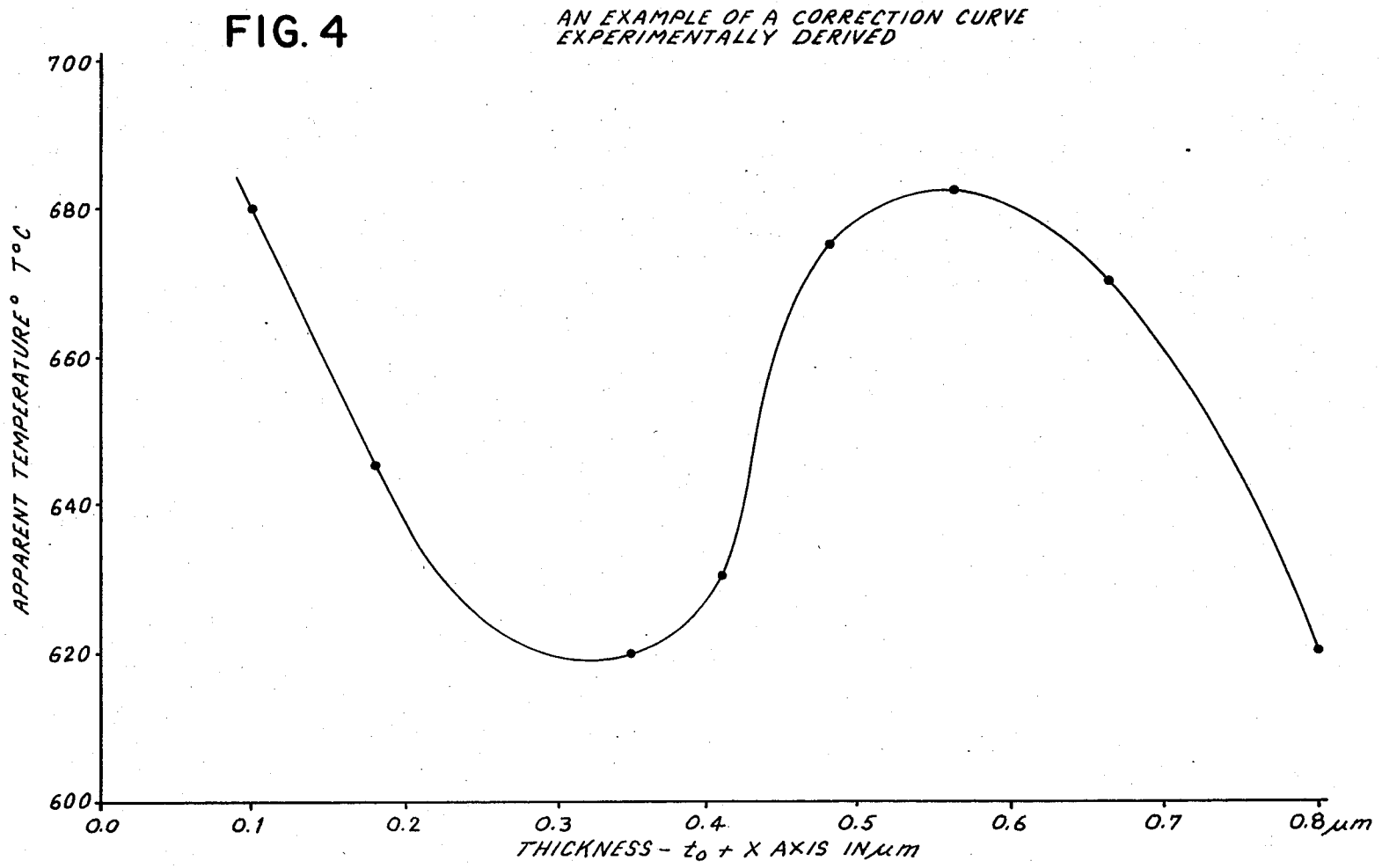
FIG. 4 is the correction factor curve in accordance with the invention.
Figure 5:
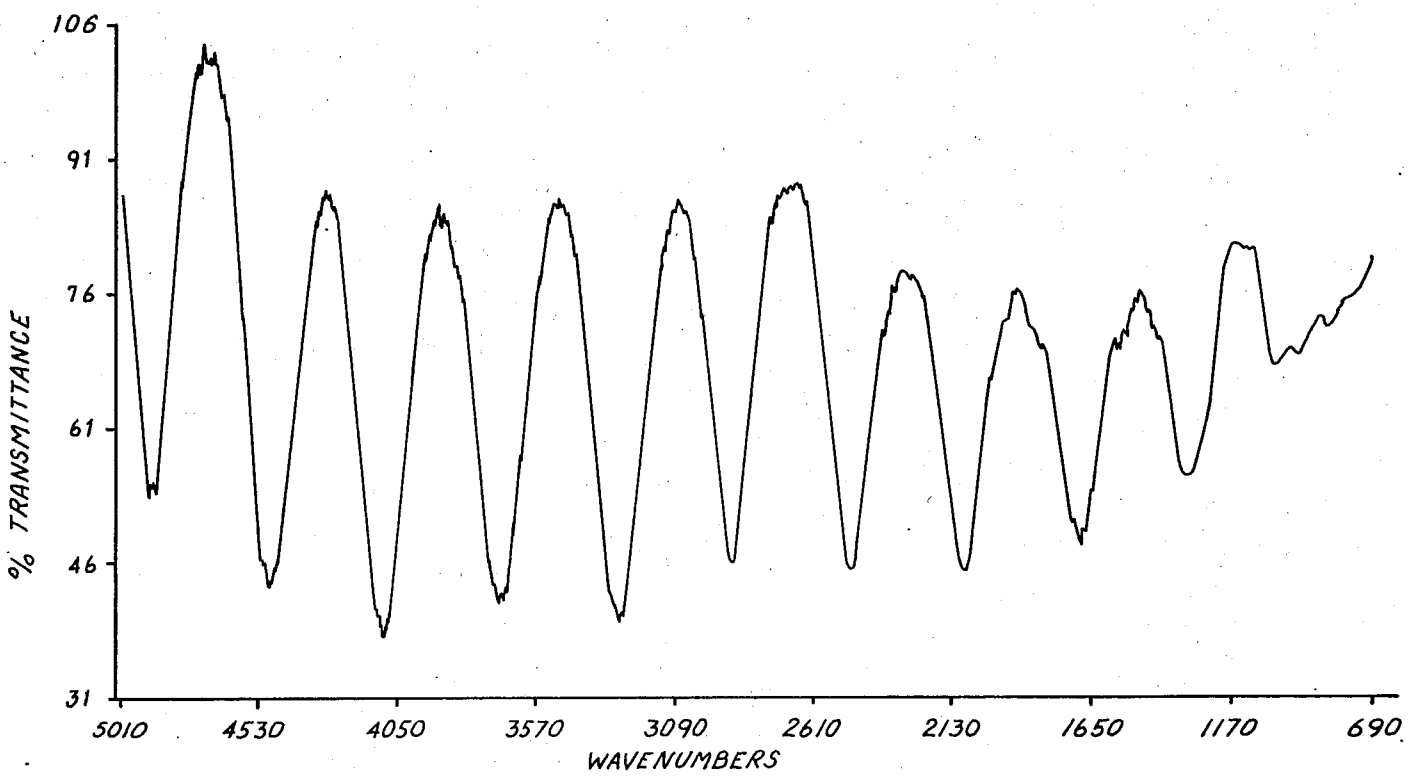
FIG. 5 is a graph of an interference pattern.

In order to apply the correction for an unknown cathode, one has only to measure the wafer thickness by a nondestructive technique. Once the thickness is known, the apparent temperature which is needed to achieve the desired actual temperature is determined from the curve. One such method of measuring thickness consists of determining the fringe spacings in the infrared as the wave number is varied. This measurement can be done on a conventional infrared spectrophotometer or on a Fourier transform infrared instrument. The thickness is calculated from the fringe spacing and used to look up the correction factor on the previously generated compensation curve. FIG. 4 shows the correction factor for achieving an actual temperature of 600° C. For example, in order to achieve an actual heat cleaning temperature of 600° C., a wafer having a thickness of 0.3 μm is raised to an apparent temperature of approximately 620° C. as determined from FIG. 4. Applying a correction factor based on the thickness of the material versus an apparent temperature to establish a predetermined actual temperature of the structure may also be accomplished by formulating a program which can be inserted into a computer. When the correction factor has been determined, the heat being emitted by the heat source is adjusted to achieve the predetermined actual temperature. A typical interference curve is shown in FIG. 5.

While the methods of this invention have been described with reference to temperature measurement of gallium arsenide photoemissive cathode structures during heat cleaning, the method is applicable to the measurement of temperature of any other layered structures, especially those comprised of layers of infrared transparent materials on glass or metals.

While I have described above the principles of my invention in connection with specific apparatus, it is to be clearly understood that this description is made only by way of example and not as a limitation to the scope of my invention as set forth in the objects thereof and in the accompanying claims.

What is claimed is:

1. A method of regulating the temperature of a photoemissive cathode structure which includes at least one layer of an infrared transparent material comprising the steps of:

determining the thickness of the infrared transparent material;

subjecting the layered structure to a heat source in an enclosed chamber; arriving at a correction factor by subjecting a plurality of photoemissive cathodes each having an infrared transparent layer bonded thereto to a predetermined temperature;

measuring the thickness of each layer;

averaging the apparent temperature of each layer and the thickness measurements; and establishing an apparent temperature corresponding to a desired actual temperature for a particular layer thickness;

establishing a predetermined actual temperature of the structure by applying a correction factor based on the thickness of the material versus the apparent temperature; and adjusting the amount of heat being emitted by the heat source to achieve the predetermined temperature.

2. The method of claim 1 further comprising:

removing a portion from each infrared layer;

repeating the arriving step; and forming a curve of apparent temperatures versus thickness.

3. The method of claim 1 wherein the establishing step includes determining the apparent temperature of the material by measuring the level of radiation being emitted by the material.

4. The method of claim 1 wherein the establishing step is accomplished by formulating a program which can be inserted into a computer.

5. The method of claim 4 wherein the adjusting step is performed automatically from the output of the computer.

* * * * *